United States Patent [19]

Paxton

[11] 4,017,105

[45] Apr. 12, 1977

[54] LOCK FOR SLIDING WINDOWS AND DOORS

[76] Inventor: Lee C. Paxton, 5050 North Ave., Carmichael, Calif. 95608

[22] Filed: Dec. 19, 1975

[21] Appl. No.: 642,252

[52] U.S. Cl. ..... 292/288; 49/449; 292/251; 292/DIG. 46

[51] Int. Cl.[2] ..... E05C 19/18

[58] Field of Search ..... 49/449–451; 292/251, 288, DIG. 15, DIG. 46

[56] References Cited

UNITED STATES PATENTS

| | | | |
|---|---|---|---|
| 2,256,100 | 9/1941 | Miegela | 292/251 |
| 3,233,500 | 2/1966 | Devellier | 85/46 |
| 3,622,190 | 11/1971 | Mohun | 292/288 |

*Primary Examiner*—James C. Mitchell
*Attorney, Agent, or Firm*—Blair & Brown

[57] ABSTRACT

The present invention is directed to a lock detachably engaged in a hole in the frame of a sliding window or door with an element on the lock engaging against the window or door to prevent the window or door from being slid from its closed position toward an open position. The lock includes a double lead thread for fast action. An arm on the lock for engagement with the window can be positioned in either of two vertically spaced reduced diameter portions on the lock shaft.

6 Claims, 4 Drawing Figures

LOCK FOR SLIDING WINDOWS AND DOORS

BACKGROUND OF THE INVENTION

FIELD OF THE INVENTION

The present invention relates to removable locks for sliding windows and doors to prevent the windows or doors from being opened.

SUMMARY OF THE INVENTION

The present invention includes a vertical shaft having a thread with a double lead thread at its lower end for threading itself into an opening in the window or door frame. The shaft has an arm extending outwardly therefrom into contact with the sliding window or door to prevent the window or door from moving toward an open position. When desired to use the window or door, the lock is completely removed to permit the window or door to be slid to an open position.

The primary object of the invention is to provide a hand removable sliding window or door lock which will prevent the window or door from being opened from the outside.

Other objects and advantages will become apparent in the following specification when considered in light of the attached drawings.

DESCRIPTION OF THE PREFERRED EMBODIMENT

Figure 1:
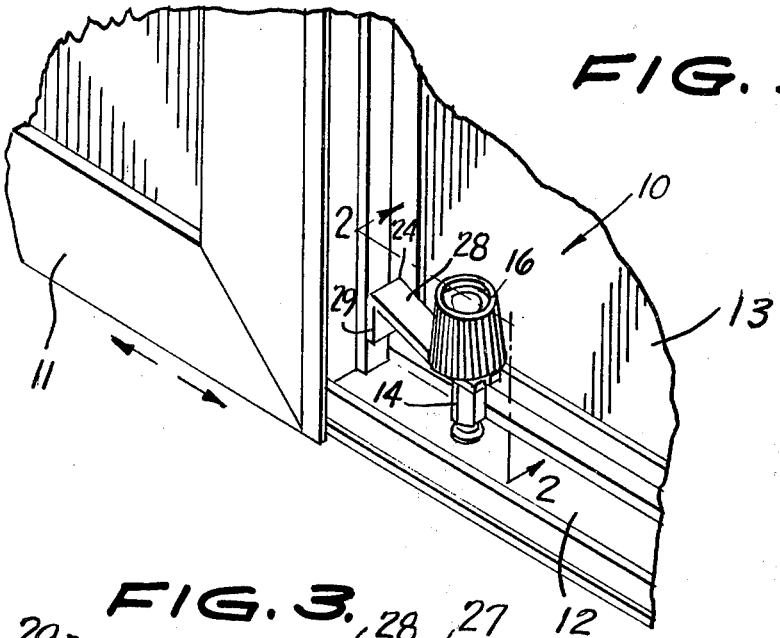
FIG. 1 is a perspective view of the invention with the frame and sliding window shown partially broken away for convenience of illustration.
Figure 3:
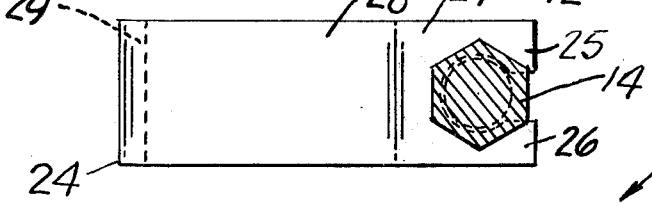
FIG. 3 is a horizontal sectional view taken along the line 3—3 of FIG. 2 looking in the direction of the arrows.

Referring now to the drawings in detail wherein like reference characters indicate like parts throughout the several figures, the reference numeral 10 indicates generally a lock for sliding windows or doors constructed in accordance with the invention.

The lock 10 is adapted for use with a sliding window or door 11 which is movable horizontally in a frame 12 which also supports a stationary window 13.

Figure 2:
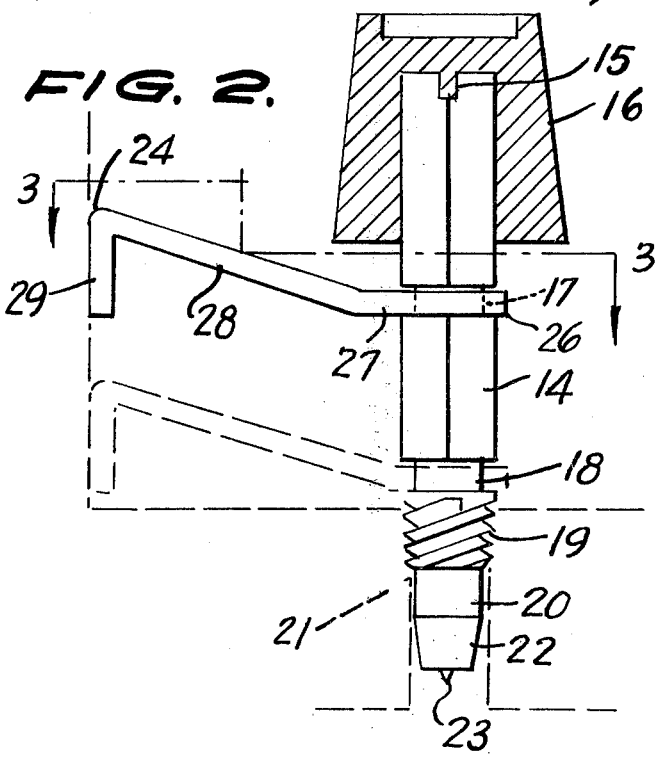
FIG. 2 is an enlarged vertical sectional view of the door or window lock taken on the line 2—2 of FIG. 1 looking in the direction of the arrows.

The lock 10 includes a generally hexagonal shaft 14 which is slotted at 15 in its upper end and has a knob 16 snugly slip fitted to the upper end portion as can be seen in FIG. 2. The shaft 14 has a reduced diameter portion 17 slightly below the knob 16 and a second reduced diameter portion 18 spaced well below the reduced diameter portion 17.

Figure 4:
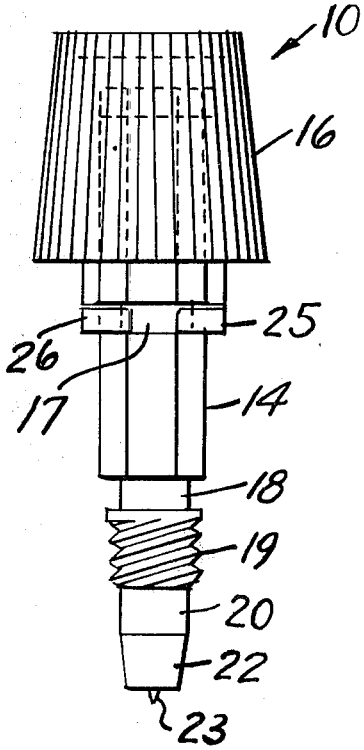
FIG. 4 is an end elevation of the invention.

A double lead self-threading thread 19 is formed on the shaft 14 below the reduced diameter portion 18 as can be seen in FIGS. 2 and 4. The shaft 14 has a cylindrical reduced diameter extension 20 below the thread 19 to serve as a pilot when inserting the lock 10 in a drilled hole 21 in the window frame 12. The pilot 20 has a tapered extension 22 extending downwardly therefrom and having an axial center punch 23 formed on its lower end.

An arm 24 is provided at one end with a pair of spaced extensions 25 and 26 which are adapted to snap over the reduced diameter portions 17, 18 as desired. The arm 24 has a generally horizontal portion 27 with an integral upwardly sloping portion 28 formed thereon. A flange 29 extends downwardly from the upper end of the upwardly sloping portion 28 for engaging against the door or window 11. In the event that the window frame 12 and the door or window 11 are so constructed that the arm 24 cannot be used in one of the reduced diameter portions 17, 18, then it can be shifted to the other of the reduced diameter portions 17, 18.

The hexagonal shaft 14 can be turned with a wrench should the thread 19 become lodged in the frame 12 tighter than can be handled with the fingers turning the knob 16.

In the use and operation of the invention, the lock is positioned in the locking position with the flange 29 against the door or window 11 with the shaft 14 in a vertical position and the end of shaft 14 is tapped lightly with a hammer so as to cause the prick 23 to form a drill starting point in the frame 12. A hole slightly smaller than the thread 19 is then drilled through the window frame 12 and the pilot 20 is placed in the hole and pressed downwardly to engage the threads with the edges of the hole. The shaft 14 is then turned with a wrench, a nutdriver, or a screwdriver in slot 15 to cut threads in hole 21. The lock 10 should then be in a locking position relative to the window or door 11. In the event that a slight opening of the door is desired for purposes of ventilation, additional threaded holes 21 can be made in the frame 12 at desired intervals. The knob 16 is then placed on shaft 14 for actuation with finger pressure.

Having thus described the preferred embodiment of the invention, it should be understood that numerous structural modifications and adaptations may be resorted to without departing from the spirit of the invention.

What is claimed is:

1. A lock for sliding windows or doors of a type including a frame comprising a shaft, means on said shaft for detachably securing said shaft to the frame, means on said shaft extending upwardly and laterally for engaging the sliding window or door, and hand actuated means on said shaft for twisting said shaft into and out of locked position with respect to said window or door.

2. A device as claimed in claim 1 wherein the means on said shaft for detachably securing said shaft to the frame comprises a double lead self-tapping thread on the lower end portion of said shaft to screw the threads into the frame.

3. A device as claimed in claim 1 wherein a center punch is formed on the lower end of said shaft for positioning the hole for said shaft in said frame.

4. A device as claimed in claim 1 wherein the means on said shaft for engaging said window or door comprises an arm detachably connected to a reduced diameter groove of said shaft and extending laterally from said shaft into engagement with said window or door.

5. A device as claimed in claim 4 wherein vertically spaced means of reduced diameter are provided on said shaft for engagement by said arm.

6. A device as claimed in claim 1 wherein a knob is removably positioned on said shaft for actuation with finger pressure.

* * * * *